US008177097B2

(12) United States Patent
Duran

(10) Patent No.: US 8,177,097 B2
(45) Date of Patent: May 15, 2012

(54) PERSONAL HYDRATION SYSTEMS, DRYER MECHANISMS FOR USE WITH PERSONAL HYDRATION SYSTEMS, AND METHODS OF DRYING PERSONAL HYDRATION SYSTEM RESERVOIRS

(75) Inventor: Leonard John Duran, San Francisco, CA (US)

(73) Assignee: CamelBak Products, LLC, Petaluma, CA (US)

( * ) Notice: Subject to any disclaimer, the term of this patent is extended or adjusted under 35 U.S.C. 154(b) by 283 days.

(21) Appl. No.: 12/633,691

(22) Filed: Dec. 8, 2009

(65) Prior Publication Data

US 2011/0132932 A1 Jun. 9, 2011

(51) Int. Cl.
*B65D 35/56* (2006.01)

(52) U.S. Cl. ..... 222/105; 222/175; 34/104

(58) Field of Classification Search ..... 222/175, 222/105, 209, 213, 214; 224/148.1–148.6; 34/102–106; 248/95–100
See application file for complete search history.

(56) References Cited

U.S. PATENT DOCUMENTS

| | | | | |
|---|---|---|---|---|
| 4,526,298 | A | 7/1985 | Boxer et al. | |
| 5,806,726 | A | 9/1998 | Ho | |
| 5,913,456 | A | 6/1999 | Dikeman | |
| 6,243,967 | B1 | 6/2001 | Dovolas | |
| 6,666,360 | B1 | 12/2003 | Swank | |
| 6,908,015 | B2 * | 6/2005 | Choi et al. | 222/175 |
| 7,014,077 | B2 | 3/2006 | Brown | |
| 7,070,075 | B2 | 7/2006 | Forsman et al. | |
| 7,568,673 | B2 | 8/2009 | Evingson | |
| 8,020,730 | B2 * | 9/2011 | Liang et al. | 222/175 |
| 2004/0244216 | A1 | 12/2004 | Poole | |
| 2005/0279784 | A1 | 12/2005 | Swank | |
| 2006/0038028 | A1 | 2/2006 | Miller et al. | |
| 2006/0071006 | A1 | 4/2006 | Lojkutz et al. | |
| 2006/0163284 | A1 | 7/2006 | Karl et al. | |
| 2006/0255048 | A1 | 11/2006 | Bemis | |
| 2008/0067202 | A1 | 3/2008 | Silva et al. | |
| 2008/0277433 | A1 | 11/2008 | Karl et al. | |
| 2008/0308578 | A1 * | 12/2008 | Skillern et al. | 222/209 |

FOREIGN PATENT DOCUMENTS

WO WO 2005/020593 2/2006

* cited by examiner

*Primary Examiner* — Lien Ngo
(74) *Attorney, Agent, or Firm* — DASCENZO Intellectual Property Law, P.C.

(57) ABSTRACT

Personal hydration systems include a flexible bladder, a fill port assembly, an exit port, and a dryer mechanism. The dryer mechanism is configured to be selectively positioned to engage the outer surface of the flexible bladder and deform the flexible bladder from a non-drying configuration into a drying configuration in which opposing side portions are spaced further apart from each other and further away from the central axis of the flexible bladder than when the flexible bladder is in the non-drying configuration to enable circulation of air in the internal compartment of the flexible bladder. In some embodiments, the dryer mechanism is coupled to the fill port assembly. In some embodiments, the dryer mechanism includes at least one elongate member that is pivotally coupled to the fill port assembly.

21 Claims, 4 Drawing Sheets

PERSONAL HYDRATION SYSTEMS, DRYER MECHANISMS FOR USE WITH PERSONAL HYDRATION SYSTEMS, AND METHODS OF DRYING PERSONAL HYDRATION SYSTEM RESERVOIRS

FIELD OF THE DISCLOSURE

The present disclosure relates generally to personal hydration systems, and more particularly to personal hydration systems with improved reservoir assemblies, dryer mechanisms for use with personal hydration systems, and methods of drying personal hydration system reservoirs.

BACKGROUND OF THE DISCLOSURE

For some time, people have recognized the need to stay hydrated. Conventionally, many individuals carry drink bottles that contain water or other drink fluids, such as sports drinks, juices, etc. More recently, personal hydration systems have become increasingly popular. Personal hydration systems allow a user to drink more or less continuously while engaged in sporting, athletic, or other recreational activities. Personal hydration systems typically include a bag-like fluid reservoir that is carried in a backpack or waist pack. A long flexible tube extends from the reservoir to a mouthpiece and permits a user to draw drink fluid from the reservoir as needed or otherwise as desired by the user.

SUMMARY OF THE DISCLOSURE

The present disclosure is directed to personal hydration systems that include a flexible bladder, a fill port assembly, an exit port, and a dryer mechanism. Also disclosed are personal hydration system kits that include a reservoir assembly and a dryer mechanism, stand-alone dryer mechanisms that may be used with personal hydration systems, and methods of drying internal compartments of personal hydration system reservoirs.

Dryer mechanisms according to the present disclosure are configured to be selectively positioned to engage the outer surface of the flexible bladder and deform the flexible bladder from a non-drying configuration into a drying configuration. In the drying configuration, the opposing side portions are spaced further apart from each other and further away from the flexible bladder's central axis than when the flexible bladder is in the non-drying configuration, thereby enabling circulation of air throughout the internal compartment. In some embodiments, the dryer mechanism is operatively coupled to the flexible reservoir, such as via the fill port assembly. In some embodiments, the dryer mechanism includes at least one elongate member that is pivotally coupled to the fill port assembly and that is configured to be pivoted from a stowed configuration to a deployed configuration in which the elongate member engages and deforms the flexible bladder from the non-drying configuration to the drying configuration.

Methods of drying personal hydration systems according to the present disclosure include engaging the outer surface of a flexible bladder of a personal hydration system reservoir assembly, and deforming the flexible bladder from a non-drying configuration into a drying configuration, in which opposing side portions of the flexible bladder are spaced further apart from each other and further away from a central axis of the flexible bladder than when the flexible bladder is in the non-drying configuration to enable circulation of air in the internal compartment of the flexible bladder.

DETAILED DESCRIPTION AND BEST MODE OF THE DISCLOSURE

Figure 1:
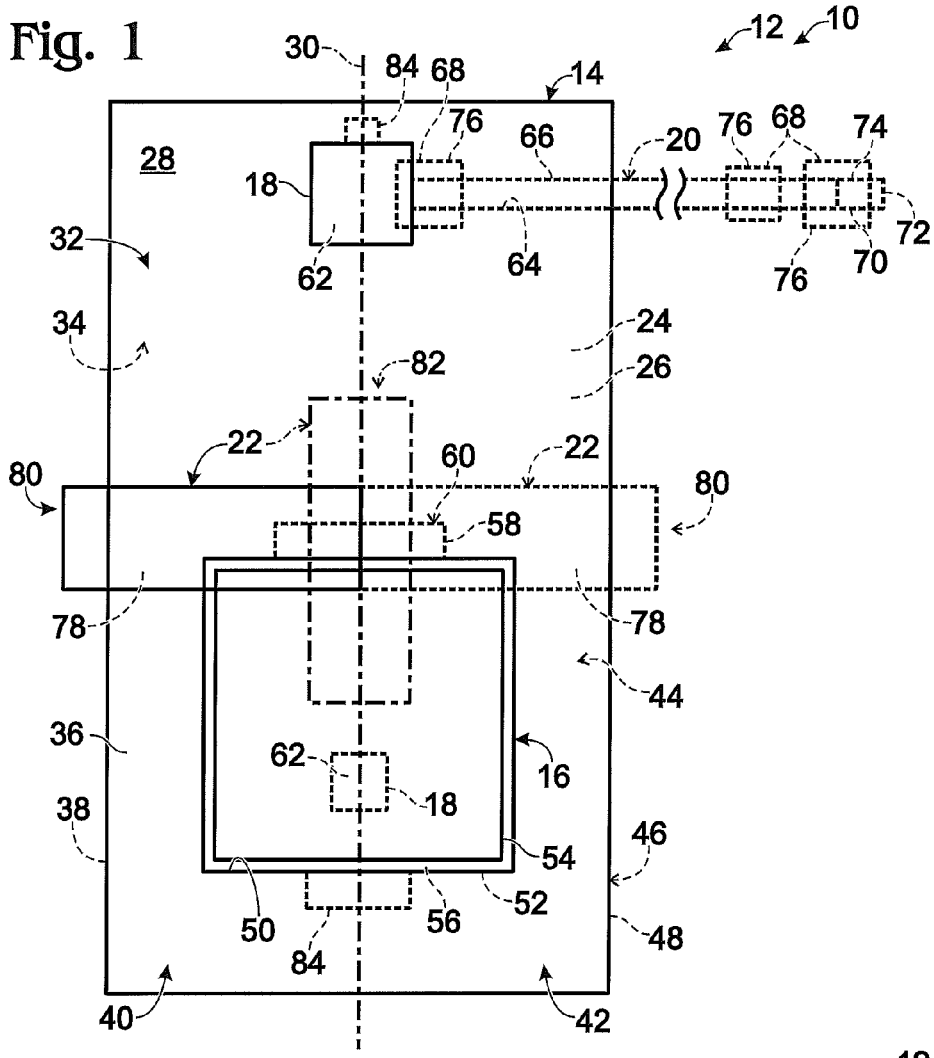
FIG. 1 is a schematic diagram of personal hydration system reservoir assemblies according to the present disclosure.

Personal hydration systems according to the present disclosure are schematically illustrated in FIG. 1 and are generally indicated at 10. More specifically, reservoir assemblies of personal hydration systems 10 are schematically illustrated in FIG. 1 and are generally indicated at 12. That is, a personal hydration system 10 according to the present disclosure includes a reservoir assembly 12 according to the present disclosure, but, as discussed herein, it is within the scope of the present disclosure that a personal hydration system 10 may (but is not required to) include more than a reservoir assembly 12. For example, as discussed herein, reservoir assemblies according to the present disclosure may be designed to be used in conjunction with a backpack or a waist mounted pack to enable a user to consume drink fluid while wearing the associated pack on the user's body without having to first remove the pack or remove the reservoir assembly from the pack. Additionally or alternatively, reservoir assemblies according to the present disclosure may be used in conjunction with personal hydration garments, or clothing configured to support the reservoir assembly, illustrative, non-exclusive examples of which are disclosed in U.S. Provisional Patent Application Ser. No. 61/127,398, the disclosure of which is hereby incorporated by reference. It is within the scope of the present disclosure that such a back- or waist-mounted pack or hydration garment is considered a component of a personal hydration system 10. Other components, in addition to reservoir assemblies, packs, and garments, also may be considered components of personal hydration systems 10 according to the present disclosure.

As schematically illustrated in solid lines in FIG. 1, reservoir assemblies 12 according to the present disclosure include at least a flexible bladder 14, a fill port assembly 16, and an exit port 18. As schematically illustrated in dashed lines in FIG. 1, reservoir assemblies 12 may further include a downstream assembly 20 extending from the exit port; however, it is within the scope of the present disclosure that a reservoir assembly 12 may be provided without a downstream assembly but be configured to be coupled to a downstream assembly. FIG. 1 also schematically illustrates a dryer mechanism 22, which may or may not be a component of a reservoir assembly 12 according to the present disclosure. That is, in some embodiments, the reservoir assembly may include the dryer mechanism. Additionally or alternatively, a separate and distinct dryer mechanism may be provided that is configured to be used in conjunction with and/or that is configured to be selectively coupled to a reservoir assembly according to the present disclosure. In such examples, the combination of the reservoir assembly and the dryer mechanism additionally or alternatively may be referred to as a personal hydration system kit.

Flexible bladder 14 defines an internal compartment 24 that is sized to hold or contain, up to a predetermined maximum volume of drink fluid 26, such as for selective consumption by a user through the hydration system's downstream assembly. The predetermined maximum volume of drink fluid also may be referred to as the capacity of the flexible bladder and/or the capacity of the flexible bladder's internal compartment. However, because the flexible bladder is flexible, the internal compartment may define various volumes depending on the volume of drink fluid currently being held by the flexible bladder. As an illustrative, non-exclusive example, when the flexible bladder is empty, or at least nearly empty, of drink fluid, the internal compartment may effectively have zero, or at least near zero and/or a small, volume. As a further, illustrative, non-exclusive example, when the flexible bladder does not contain drink fluid, and often when it only contains minimal drink fluid, in its internal compartment, the bladder may have a volume that is less than 25%, less than 10%, less than 5%, or less than the volume of the bladder when it contains its predetermined maximum volume of drink fluid.

The flexible bladder includes an outer surface 28, and the flexible bladder and/or the internal compartment may be described as defining a central axis 30, such as schematically indicated in FIG. 1. In some configurations of flexible bladders according to the present disclosure, central axis 30 also may be referred to as a longitudinal axis or a central longitudinal axis. As discussed herein, portions of the flexible bladder will extend in various spaced relations to each other and to the central axis, such as depending on the configuration of the bladder, the volume of drink fluid in the bladder, and/or the drying mechanism. In the schematic diagram of FIG. 1, flexible bladder 14 is shown including opposing side portions 32, 34. Side portion 32 is indicated as generally facing out of the page, and side portion 34 is indicated as generally facing into the page. Accordingly, opposing side portions 32, 34 may additionally or alternatively be referred to as, or may be defined at least partially by, a front portion 36 and a rear portion 38, and/or a front face 36 and a rear face 38, respectively. Additionally or alternatively, flexible bladder 14 may be described as including a left portion 40 and a right portion 42, as schematically indicated in FIG. 1. The left portion and the right portion collectively may additionally or alternatively be referred to as a pair of generally opposed edge regions. One or more of opposing side portions, the front portion, the rear portion, the left portion, and the right portion may individually or collectively define outer surface 28 of the flexible bladder.

Additionally or alternatively, the flexible bladder may include, or be constructed with, a front panel 44 and a rear panel 46 that is coupled to the front panel, such that a seam, or seal, 48 is defined therebetween. Accordingly, the front panel, when present, may define front portion 36, and the rear panel, when present, may define rear portion 38. In the schematic diagram of FIG. 1, the seam between the front panel and the rear panel corresponds to the perimeter of the flexible bladder. Such a configuration is not required to all flexible bladders 14 according to the present disclosure, and it is within the scope of the present disclosure that the flexible bladder may be constructed in any suitable manner. When present, the one or both of the front panel and the rear panel may individually or collectively define, or include, outer surface 28 of the flexible bladder.

Flexible bladders 14 may have any suitable shape and be formed from any suitable material or combinations of materials to hold up to a predetermined maximum volume, or capacity, of drink fluid. Illustrative, non-exclusive examples of suitable capacities of internal compartment 24 (i.e., volume of drink fluid 26 able to be received into a flexible bladder at one time) include at least 24 fluid ounces (0.7 liters), at least 32 fluid ounces (0.9 liters), at least 50 fluid ounces (1.5 liters), at least 70 fluid ounces (2.1 liters), at least 100 fluid ounces (3.0 liters), at least 150 fluid ounces (4.4 liters), at least 200 fluid ounces (5.9 liters), more than 200 fluid ounces (5.9 liters), 24-50 fluid ounces (0.7-1.5 liters), 50-80 fluid ounces (1.5-2.4 liters), 32-100 fluid ounces (0.9-3.0 liters), 100-150 fluid ounces (3.0-4.4 liters), and 100-200 fluid ounces (3.0-5.9 liters). It is within the scope of the present disclosure that internal compartments having different capacities including capacities that are smaller than, larger than, or within the illustrative sizes and/or ranges presented above, may be used without departing from the scope of the present disclosure.

An illustrative, non-exclusive example of a material that may be used to construct flexible bladders 14 according to the present disclosure includes polyurethane. Other materials are also within the scope of the present disclosure, including materials that are configured to be resistant to chemical and/or biological agents, such as to mustard blister agent and/or sarin nerve agent. Illustrative, non-exclusive examples of such materials, including examples of the constructions of such materials, are disclosed in U.S. Pat. Nos. 7,073,688 and 6,676,998, the disclosures of which are hereby incorporated by reference. It is also within the scope of the present disclosure that other components, and not just the flexible bladder, of reservoir assemblies according to the present disclosure are configured to be resistant to chemical and/or biological agents.

Fill port assembly 16 is coupled to flexible bladder 14 and defines an opening 50 to internal compartment 24. Fill port assembly 16 may be disposed on front portion 36, or front panel 44, when present, of the flexible bladder and may take any suitable form such that it is configured at least to permit selective filling of the internal compartment with drink fluid. The fill port assembly also may permit selective dispensing of drink fluid from the internal compartment, for example, to clean and/or dry-out the internal compartment.

Fill port assembly 16 may include a fill port 52 that defines the opening 50 to the internal compartment, and a cap, or other closure, 54 configured to selectively mate with the fill port and seal the opening. Fill port 52, when present, may additionally or alternatively be described as defining, and/or as including a neck. Fill port 52 may have a rigid, or semi-rigid construction, and as such may be more rigid than the flexible reservoir. Accordingly, when the fill port is at least semi-rigid, in contrast to the flexible bladder, the fill port, when present, may provide structure to permit a user to easily grasp the reservoir assembly, to selectively couple the cap to and decouple the cap from the neck, and otherwise to readily manipulate the reservoir assembly.

Other configurations of fill port assemblies are also within the scope of the present disclosure, and may include such illustrative, non-exclusive structures as thread structures, snap-fit structures, clip structures, zipper structures, slide structures, ZIPLOC®-style structures, folding structures, etc. Illustrative, non-exclusive examples of fill port assemblies that may be incorporated into personal hydration systems according to the present disclosure are disclosed herein and in U.S. Pat. Nos. 5,941,640, 6,675,998, and 7,014,077, and U.S. Patent Application Publication Nos. 2007/0280564, 2007/0280565, and 2002/0094140, the disclosures of which are hereby incorporated by reference.

Additionally or alternatively, fill port assembly 16 may further include a support member 56 operatively coupled to the flexible bladder, such as via fill port 52, such as extending around or within a perimeter of the fill port. Stated differently, the support member may at least substantially encircle the opening to the internal compartment. When present, the support member may provide further rigidity to the fill port assembly, for example to permit a user to easily grasp the reservoir assembly, to selectively couple the cap to and decouple the cap from the neck, and otherwise to readily manipulate the reservoir assembly.

Fill port assembly 16 may additionally or alternatively include a handle 58, as schematically illustrated in dashed lines in FIG. 1. The handle, when present, may extend from optional support member 56 and/or may be described as a portion of the support member. Additionally or alternatively, the combination of the support member and the handle may be described as a wrench assembly 60.

Opening 50 of reservoir assemblies 12 according to the present disclosure may be sized in any suitable configuration. For example, the opening may be sized to permit a user's hand to pass through the opening, for example, to permit the internal compartment to be easily accessed, such as for cleaning and/or drying. Additionally or alternatively, the opening may be sized to permit a user to insert ice cubes through the opening. Additionally or alternatively, the opening may be sized so as to facilitate easy filling of the internal compartment with drink fluid. Additionally or alternatively, the opening may be sized so as to enable circulation of air into the internal compartment of the flexible bladder. Illustrative, non-exclusive examples of openings 50 according to the present disclosure include openings with diameters of at least 50 mm, 60 mm, 75 mm, 90 mm, or 100 mm, with diameters between about 50 mm and about 100 mm, with areas of at least 3,000 $mm^2$, 3,500 $mm^2$, 4,000 $mm^2$, 4,500 $mm^2$, 5,000 $mm^2$, 5,500 $mm^2$, and 6,000 $mm^2$, and/or with areas between about 3,000 $mm^2$ and about 6,000 $mm^2$. It is within the scope of the present disclosure that openings having different sizes, or dimensions, including sizes that are smaller than, larger than, or within the illustrative sizes and/or ranges presented above, may be used without departing from the scope of the present disclosure.

Exit port 18 defines a passage 62 for delivering drink fluid from the internal compartment, for example, for delivery to a downstream assembly 20, when present. As such, the exit port, and any attached downstream assembly may be described as being in fluid communication with the internal compartment of the flexible bladder. Exit port 18 may take any suitable form, construction, and/or configuration, illustrative, non-exclusive examples of which are disclosed in U.S. Pat. Nos. 5,727,714 and 6,908,015, and U.S. Patent Application Publication No. 2006/0231561, the disclosures of which are hereby incorporated by reference.

In FIG. 1, exit port 18 is schematically indicated in solid lines spaced away from fill port assembly 16; however, it is also within the scope of the present disclosure, such as schematically illustrated in dashed lines in FIG. 1, that an exit port 18 may be integral to, and/or otherwise form a portion of, the fill port assembly, such as (but not limited to), integral to cap 54, when present. That is, it is within the scope of the present disclosure that an exit port may define a passage 62 through the cap for delivering drink fluid from the internal compartment. An illustrative, non-exclusive example of such an exit port and cap combination is disclosed in U.S. Patent Application Publication No. 2007/0280565, incorporated herein.

As discussed, reservoir assemblies 12 according to the present disclosure may further include a downstream assembly 20, either extending from exit port 18 or that is configured to be selectively coupled to the exit port. The downstream assembly, when present, may take any suitable form such that it defines a fluid conduit 64 through which drink fluid may flow from the internal compartment, via the exit port. For example, as illustrative, non-exclusive examples, and as schematically illustrated in FIG. 1, the downstream assembly may include a plurality of fluidly interconnected components, such as including one or more of a length of hollow drink tubing 66 through which drink fluid may flow, an on/off valve 68 configured to selectively obstruct the fluid conduit and restrict drink fluid from flowing through the fluid conduit, a mouthpiece 70 configured to dispense drink fluid to a user's mouth, a bite-actuated mouthpiece 72 configured to dispense drink fluid to a user's mouth upon receipt of user-applied compressive forces to the mouthpiece, a gas mask fitting 74 adapted to fluidly connect the downstream assembly to an intake of a gas mask, and a quick connect assembly 76 configured to selectively and fluidly interconnect at least two of the plurality of fluidly interconnected components. As schematically illustrated in FIG. 1, it is within the scope of the present disclosure that an on/off valve, a quick connect assembly, and/or a combination of the two, when present, may be at least partially integral to an exit port, a mouthpiece, a gas mask fitting, and/or a length of hollow drink tubing.

Illustrative, non-exclusive examples of downstream assemblies that may be incorporated into, or used with, personal hydration systems according to the present disclosure are disclosed in U.S. Pat. Nos. 6,497,348, 6,908,015, and 7,073,688, the disclosures of which are hereby incorporated by reference. Illustrative, non-exclusive examples of suitable mouthpieces, including bite-actuated mouthpieces, that may be incorporated into, or used with, downstream assemblies according to the present disclosure are disclosed in U.S. Pat. Nos. 5,727,714, 6,032,831, 6,622,988, 6,764,064, and 6,886,807, the disclosures of which are hereby incorporated by reference.

As discussed, reservoir assemblies 12 according to the present disclosure may further include a dryer mechanism 22. Additionally or alternatively, a dryer mechanism may be separate and apart from a reservoir assembly 12, but may be configured to be used in conjunction with and/or selectively coupled to a reservoir assembly according to the present disclosure. FIG. 1 schematically represents both a reservoir assembly that includes a dryer mechanism, and a reservoir assembly illustrated in conjunction with a separate dryer mechanism.

Dryer mechanisms 22 according to the present disclosure are configured to be selectively positioned to engage outer surface 28 of flexible bladder 14 and deform the flexible bladder to selectively configure the flexible bladder from a non-drying configuration into a drying configuration. In the drying configuration, the opposing side portions 32, 34 of the flexible bladder are spaced further apart from each other and further away from central axis 30 than when the flexible bladder is in the non-drying configuration, thereby permitting, or enabling, circulation of air in the internal compartment, for example, via opening 50. Accordingly, an illustrative, non-exclusive example of a method according to the present disclosure for drying the internal compartment of the flexible bladder may be described as engaging the outer surface of the flexible bladder and deforming the flexible bladder from a non-drying configuration into a drying configuration in which the opposing side portions are spaced further apart from each other and further away from the central axis than when the flexible bladder is in the non-drying configuration to enable circulation of air in the internal compartment.

Additionally or alternatively, dryer mechanisms 22 according to the present disclosure may be used to deform, or otherwise configure, the flexible bladder from the non-drying configuration into the drying configuration when the internal compartment is empty, or nearly empty of drink fluid. For example, a user may selectively and substantially empty the internal compartment of drink fluid, such as by consuming the drink fluid, by dispensing the drink fluid from the internal compartment, and/or by pouring the drink fluid from the opening of the flexible bladder. At least initially after doing so, some volume of drink fluid will likely remain within the internal compartment, for example, adhered to the inside of the flexible bladder and/or pooled in a lower portion of the internal compartment. Typically, this "nearly empty" volume of drink fluid may be less than 2% or 1% of the predetermined maximum volume of the flexible bladder. The dryer mechanism may then be used to configure the flexible bladder from the non-drying configuration, in which the volume of the internal compartment is small relative to the capacity of the flexible bladder, into the drying configuration, in which the volume of the internal compartment is increased to enable air to circulate within the internal compartment, for example, via opening 50. In some embodiments of flexible bladders, opposing side portions 32, 34 may be substantially in contact with each other and/or the bladder may have a flat shape when the flexible bladder is in the non-drying configuration. Other configurations of flexible bladders are also within the scope of the present disclosure.

Additionally or alternatively, a drying mechanism according to the present disclosure may be described as being configured to selectively squeeze the flexible bladder by contacting the outer surface of the bladder, to configure the flexible bladder from the non-drying configuration into the drying configuration. Accordingly, an illustrative, non-exclusive example of a method according to the present disclosure may be described as including squeezing the flexible bladder. Additionally or alternatively, a drying mechanism according to the present disclosure may be described as being configured to selectively increase the volume of the internal compartment to configure the flexible bladder into the drying configuration. Accordingly, an illustrative, non-exclusive example of a method according to the present disclosure may be described as including increasing the volume of the internal compartment of the flexible bladder.

Dryer mechanism 22 may take any suitable form or construction such that it is configured to selectively deform, or otherwise reconfigure, the flexible bladder from its non-drying configuration into its drying configuration. Although not required to all embodiments according to the present disclosure, a dryer mechanism may include at least one elongate member, or arm, 78 that is configured to selectively engage the outer surface of the flexible bladder and deform the flexible bladder to reconfigure the flexible bladder from the non-drying configuration into the drying configuration. In some embodiments, the dryer mechanism may include two, or at least two, elongate members 78, which may be spaced apart and/or generally opposed to each other.

In examples of personal hydration systems in which reservoir assembly 12 includes dryer mechanism 22, the dryer mechanism may be described as being operatively coupled to the flexible bladder. By operatively coupled, it is meant that the dryer mechanism may be directly or indirectly coupled to the flexible bladder. This is schematically illustrated in FIG. 1 with dryer mechanism 22 overlapping the flexible bladder and fill port assembly 16. For example, in some reservoir assemblies according to the present disclosure, the dryer mechanism may (but is not required to) be coupled to the fill port assembly. Additionally or alternatively, in embodiments in which the fill port assembly includes an optional handle 58, the dryer mechanism may (but is not required to) be coupled to the handle, such as schematically indicated by the overlapping relationship of the dryer mechanism and the optional handle in FIG. 1. Although not required to all embodiments, the coupling between the dryer mechanism and the fill port assembly (and/or a handle 58 thereof) may include a pivotal coupling and/or a coupling that defines one or more (and/or a range) of configurations of the dryer mechanism with respect to the fill port assembly and/or the flexible reservoir. Other attachment configurations of dryer mechanism 22 are also within the scope of the present disclosure.

In examples of personal hydration systems 10 in which the dryer mechanism is not a component of the reservoir assembly, and/or is not operatively coupled to the flexible bladder (at least when the flexible bladder is not in its drying configuration), the dryer mechanism may be described as being configured to be positioned to selectively engage the outer surface of the flexible bladder, such as schematically illustrated in solid lines in FIG. 1.

When a dryer mechanism 22 according to the present disclosure is engaged with outer surface 28 of the flexible bladder and has deformed the flexible bladder to thereby configure the flexible bladder to its drying configuration, the dryer mechanism may be described as being in a deployed configuration 80, such as schematically illustrated in solid lines in FIG. 1. It is within the scope of the present disclosure that dryer mechanism 22 may be designed, or configured, to retain the flexible bladder in the drying configuration until the dryer mechanism and/or flexible reservoir are disengaged or otherwise moved to a different configuration, such as by a user. In some embodiments, the dryer mechanism also may have a stowed configuration 82, such as schematically illustrated in dash-dot lines in FIG. 1, in which the dryer mechanism does not deform the flexible bladder into its drying configuration, and optionally may not even engage the flexible bladder, or at least the edge portions thereof that were engaged in the drying configuration.

In FIG. 1, the stowed configuration of the dryer mechanism is schematically indicated as partially overlapping the fill port assembly, schematically representing that when in the stowed configuration, at least a portion, if not all, of the dryer mechanism may (but is not required to) be hidden from view, such as behind a portion of the fill port assembly and/or another portion or component of reservoir assembly 12. Additionally or alternatively, in the stowed configuration, the dryer mechanism may be positioned so as to permit, or enable, insertion and removal of the reservoir assembly from a pack without the dryer mechanism restricting, preventing, or otherwise making difficult such insertion and/or removal.

Additionally or alternatively, as schematically illustrated in dashed lines in FIG. 1, dryer mechanism 22 may extend on or to and/or may engage more than one side of the flexible bladder, such as left portion 40 and right portion 42 of the flexible bladder, when the dryer mechanism is in its deployed configuration or is otherwise positioned to configure the flexible bladder to its drying configuration. That is, the dryer mechanism may be configured to selectively engage the left portion and the right portion and translate, or urge, the left portion and the right portion toward central axis 30 to selectively configure the flexible bladder into the drying configuration. The dryer mechanism further may be configured to urge the left portion and the right portion toward each other, but without the left portion and right portion coming into contact with each other within internal compartment 24, when the flexible bladder is configured by the dryer mechanism to the drying configuration. That is, while both the left portion and the right portion are being urged toward the central axis and each other, they may not be urged so far as to engage each other within the internal compartment.

Additionally or alternatively, dryer mechanism 22 may extend on or to, and/or may engage, optional seam 48, when present, when the dryer mechanism is in its deployed configuration or is otherwise positioned to configure the flexible bladder to its drying configuration. That is, the dryer mechanism may be configured to selectively engage the seam of the flexible bladder and translate, or urge, the seam toward the central axis to selectively configure the flexible bladder into the drying configuration. When in the drying configuration, the seam may not contact itself within the internal compartment.

The schematic relationship between deployed configuration 80 and stowed configuration 82 of dryer mechanism 22 in FIG. 1, schematically illustrates that the dryer mechanism, or at least a portion thereof, may pivot or otherwise move relative to the flexible bladder between the stowed configuration and the deployed configuration. For example, in embodiments that include at least one elongate member 78, the elongate member(s) may be pivotally coupled relative to the flexible bladder. In some such embodiments, the elongate member(s) may be pivotally coupled to the fill port assembly, such as to the optional handle of the fill port assembly. Other configurations are also within the scope of the present disclosure.

Additionally or alternatively, in embodiments of dryer mechanisms that include at least one elongate member 78, the dryer mechanism may be configured so that the elongate member(s) are at least partially adjacent to the optional support member 56, when present, when the dryer mechanism is in optional stowed configuration 82, and is pivotally spaced away from the optional support member when the dryer mechanism is in deployed configuration 80.

Still referring to the schematic diagram of FIG. 1, reservoir assemblies 12 according to the present disclosure may (but are not required to) further include hanging structure 84 that is configured to permit a user to selectively hang the reservoir assembly, for example, when the flexible bladder is in its drying configuration and the internal compartment is being dried. In such an example, the hanging structure may be positioned relative to the fill port assembly to permit, or enable, draining of excess drink fluid from within the internal compartment when being dried, for example, to drain out of the internal compartment via one of opening 50 and exit port 18. Additionally or alternatively, hanging structure 84 may be provided to couple, or otherwise secure, a reservoir assembly with a pack, such as a backpack. Two illustrative, non-exclusive locations of optional hanging structure 84 are schematically illustrated in FIG. 1, but other locations are also within the scope of the present disclosure. As a first illustrative, non-exclusive example, hanging structure 84 may be coupled to and/or may be integral to and/or may be defined by exit port 18. Additionally or alternatively, as another illustrative, non-exclusive example, hanging structure 84 may be coupled to and/or may be integral to and/or may be defined by fill port assembly 16.

Turning now to FIGS. 2-9, illustrative, non-exclusive examples of personal hydration systems 10 according to the present disclosure are illustrated. Where appropriate, the reference numerals from the schematic illustration of FIG. 1 are used to designate corresponding parts of personal hydration systems 10 according to the present disclosure; however, the examples of FIGS. 2-9 are non-exclusive and do not limit the present disclosure to the illustrated embodiments. That is, neither personal hydration systems nor various portions thereof are limited to the specific embodiments disclosed and illustrated in FIGS. 2-9. Personal hydration systems 10 according to the present disclosure may incorporate any number of the various aspects, configurations, characteristics, properties, etc., such as which are illustrated in the embodiments of FIGS. 2-9, in the schematic representations of FIG. 1, as well as variations thereof, without requiring the inclusion of all such aspects, configurations, characteristics, properties, etc. For the purpose of brevity, each previously discussed component, part, portion, aspect, region, etc. or variants thereof, may not be discussed again with respect to FIGS. 2-9; however, it is within the scope of the present disclosure that the previously discussed features, materials, variants, etc. may be utilized with the illustrated embodiments of FIGS. 2-9.

Figure 9:
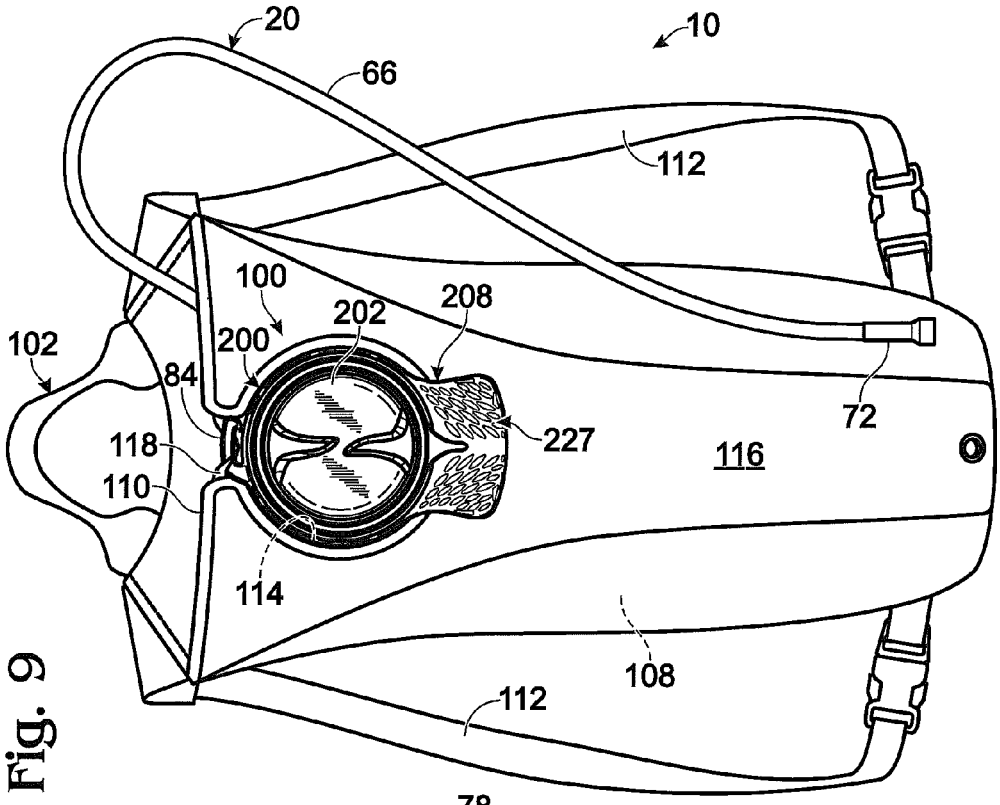
FIG. 9 is a front plan view of an illustrative, non-exclusive example of a personal hydration system according to the present disclosure, the personal hydration system including the reservoir assembly of FIG. 2 and a backpack.
Figure 8:
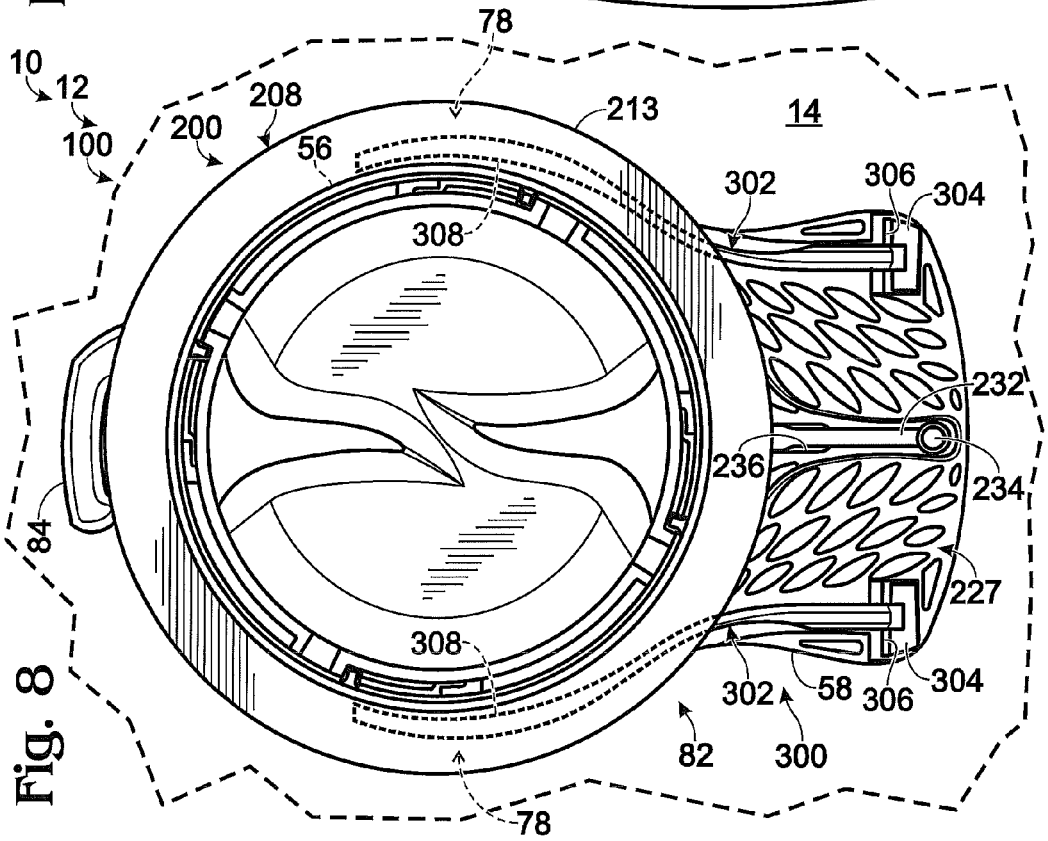
FIG. 8 is a fragmentary rear plan view of a portion of the personal hydration system reservoir assembly of FIG. 2, including the reservoir assembly's fill port assembly, and showing the reservoir assembly's flexible bladder in dashed lines.

Illustrative, non-exclusive examples of personal hydration systems 10 according to the present disclosure are illustrated in FIGS. 2-9. More specifically, an illustrative, non-exclusive example of a reservoir assembly 12 according to the present disclosure is illustrated in FIGS. 2-8, and is indicated generally at 100. FIG. 9 illustrates an illustrative, non-exclusive example of a personal hydration system 10 that includes a reservoir assembly 100 and a back-mounted pack, or backpack, 102.

Figure 2:
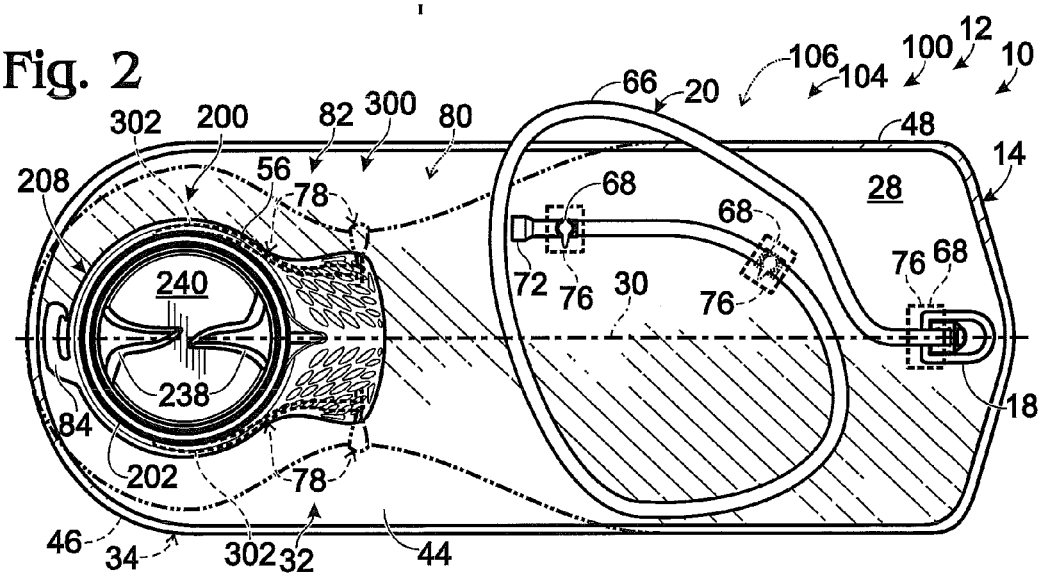
FIG. 2 is a front plan view of an illustrative, non-exclusive example of a personal hydration system reservoir assembly according to the present disclosure.
Figure 3:
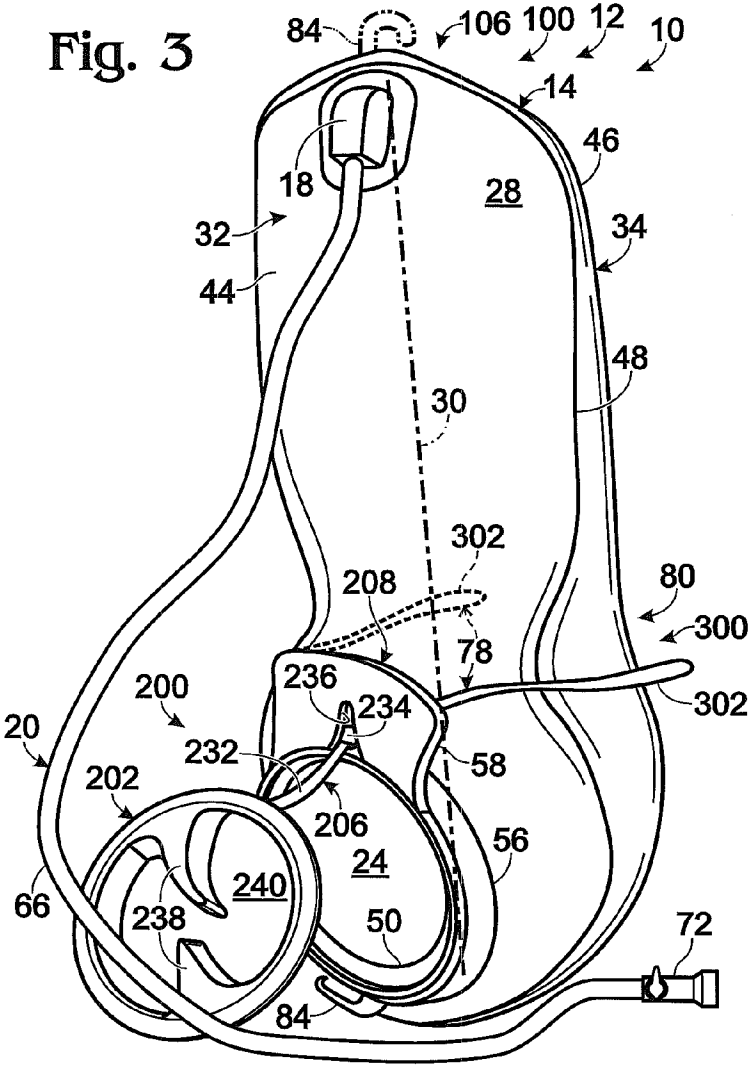
FIG. 3 is a perspective view of the personal hydration system reservoir assembly of FIG. 2, shown with the reservoir assembly's dryer mechanism in a deployed configuration and the reservoir assembly's flexible bladder in a drying configuration.

Reservoir assembly 100 includes an illustrative, non-exclusive example of fill port assembly 16, which is indicated generally at 200 in FIGS. 2-9, and reservoir assembly 100 further includes an illustrative, non-exclusive example of dryer mechanism 22, which is indicated generally at 300 in FIGS. 2-4 and 7-8. FIG. 2 illustrates reservoir assembly 100 and its flexible bladder 14 in a non-drying configuration 104 in solid lines and in a drying configuration 106 in dash-dot-dot lines. FIG. 3 illustrates reservoir assembly 100 and its flexible bladder in drying configuration 106. Similarly, in FIG. 2, dryer mechanism 300 is illustrated in its stowed configuration 82 in dashed lines and in its deployed configuration 80 in dash-dot-dot lines. In FIG. 3, the dryer mechanism is illustrated in its deployed configuration. Furthermore, in FIG. 3, the cap of the fill port assembly is illustrated in an unsealed condition so as to enable, or permit, air to enter internal compartment 24 of the flexible bladder and thereby aid in the drying of the internal compartment.

In FIG. 2, the downstream assembly 20 of reservoir assembly 100 includes an optional on/off valve 68 adjacent the bite-actuated mouthpiece 72. Optional on/off valves are also illustrated in dashed lines upstream from the bite-actuated mouthpiece 72 and proximate the exit port, illustrating that an on/off valve, when present, may be positioned at any point along the downstream assembly. FIG. 2 also schematically indicates that one or more quick connect assemblies 76 may be incorporated into reservoir assemblies 100 according to the present disclosure, as discussed herein. These optional components are not illustrated in FIGS. 3 and 9, but as discussed, it is within the scope of the present disclosure that such components are optional to reservoir assemblies according to the present disclosure. In FIG. 3, an optional location for optional hanging structure 84 is illustrated in dashed lines and, when present, may be provided to facilitate hanging of the reservoir when the flexible bladder is in its drying-configuration, such as illustrated in FIG. 3. This optional hanging structure is not illustrated in FIG. 2, but as discussed, it is within the scope of the present disclosure that such structure is optional to reservoir assemblies according to the present disclosure.

Figure 4:
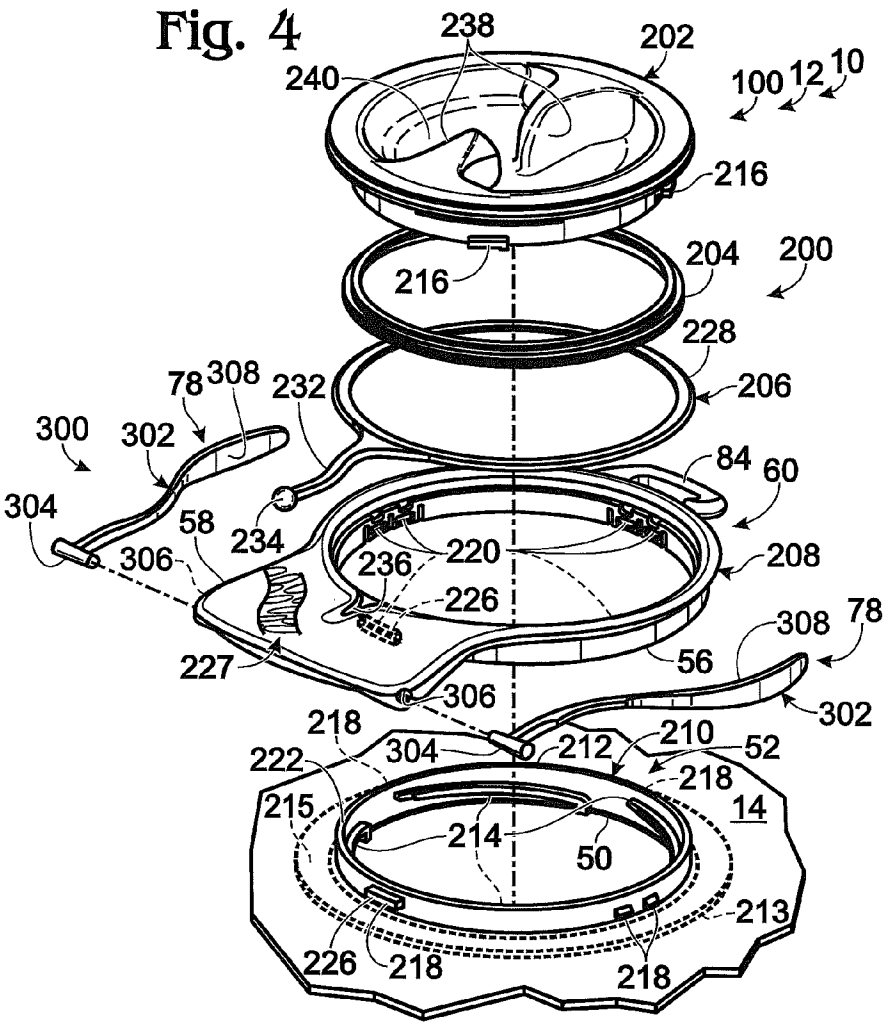
FIG. 4 is a fragmentary, perspective exploded view of a portion of the personal hydration system reservoir assembly of FIG. 2, including the reservoir assembly's fill port assembly.

As perhaps best seen in FIG. 4, fill port assembly 200 includes an illustrative, non-exclusive example of a cap 54, which is indicated generally at 202, a seal 204, a tether 206, an illustrative, non-exclusive example of a wrench assembly 60, which is indicated generally at 208, and an illustrative, non-exclusive example of a fill port 52, which is indicated generally at 210.

Fill port 210 includes a neck 212 that defines opening 50, and a flange 213 extending from the neck. The flange is welded to flexible bladder 14. In FIG. 4, the flange is illustrated in hidden lines because the flexible reservoir is welded to a front surface 215 of the flange; however, other configurations are also within the scope of the present disclosure. Fill port 210 further includes internal thread structure 214 disposed on the inside of the neck and that is configured to mate with corresponding thread structure 216 of cap 202, and snap-fit structure 218 disposed on the outside of the neck and that is configured to mate with corresponding snap-fit structure 220 disposed on the inside of wrench assembly 208. The thread structures of the fill port and the cap are configured such that a user need only rotate the cap approximately 70 degrees, or less than one-quarter turn, to selectively open and close the fill port assembly, that is, to unseal and seal the opening to the internal compartment, respectively. Seal 204 is disposed on the cap and seals against neck 212 of fill port 210 when the fill port assembly is closed, or sealed. As perhaps best seen in FIGS. 5-6, the cap includes a rib 224 extending around the perimeter of the cap that retains the seal in a desired position relative to the cap. Furthermore, when the cap is in a sealed position, the cap engages an upper lip, or edge, 222 of the neck, as best seen in FIG. 5.

Figure 5:
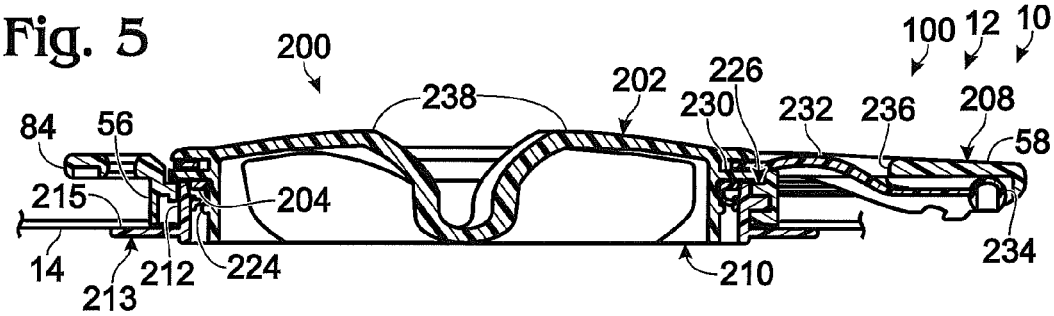
FIG. 5 is a fragmentary cross-sectional side elevation view of a portion of the personal hydration system reservoir assembly of FIG. 2, including the reservoir assembly's fill port assembly, and showing the reservoir assembly's cap in a closed configuration.
Figure 6:
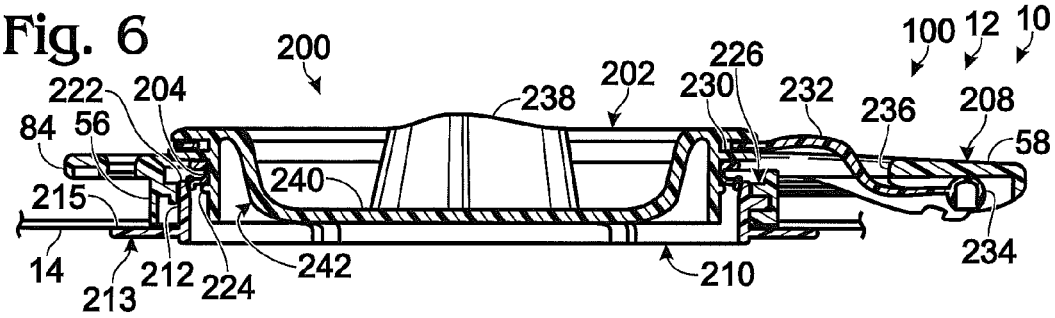
FIG. 6 is another fragmentary cross-sectional side elevation view of the portion of the personal hydration system reservoir of FIG. 2, including the reservoir assembly's fill port assembly, and showing the reservoir assembly's cap rotated approximately 90 degrees from its closed configuration illustrated in FIG. 5.
Figure 7:
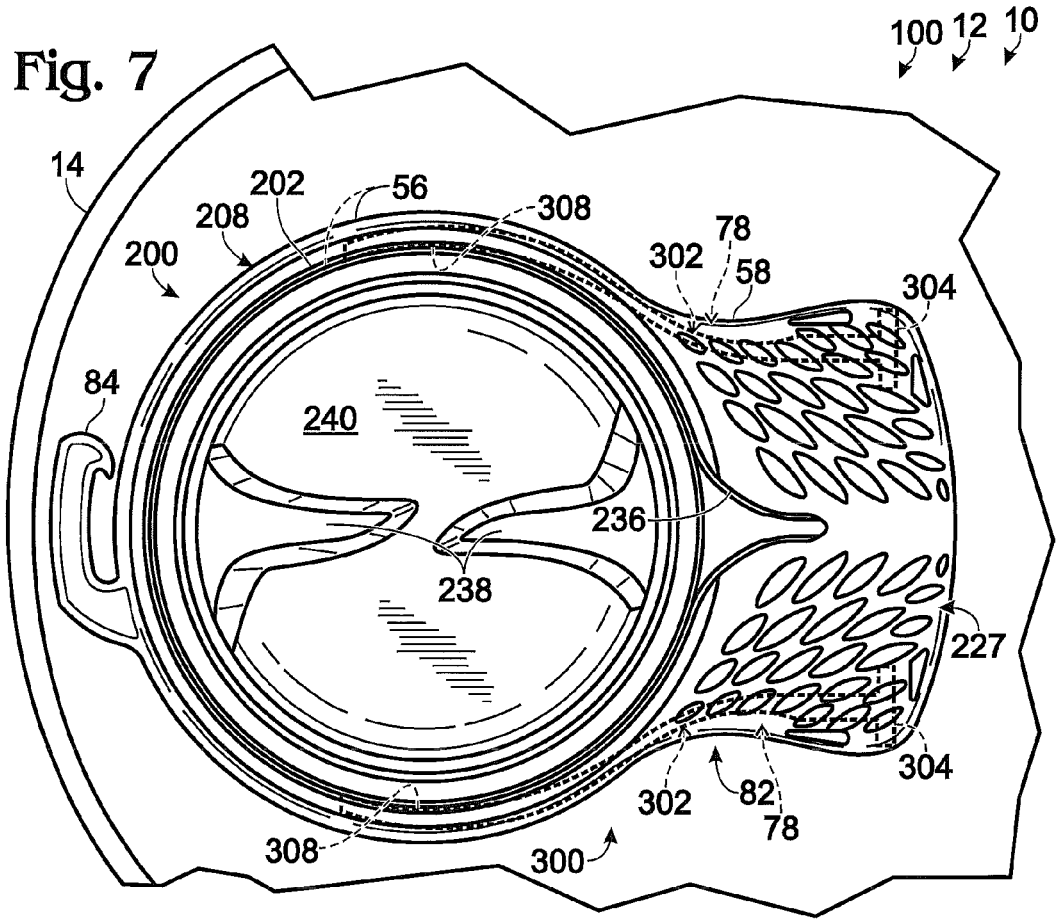
FIG. 7 is a fragmentary front plan view of a portion of the personal hydration system reservoir assembly of FIG. 2, including the reservoir assembly's fill port assembly, and showing the fill port assembly's cap in a closed configuration.

The snap-fit structures of the fill port and the wrench assembly include four discrete mating regions, with one of the mating regions being configured, or constructed, differently than the other three of the mating regions, as indicated in FIGS. 4-6 at 226. Accordingly, the wrench assembly of fill port assembly 200 is configured to mate with the fill port in only a single orientation; however, it is also within the scope of the present disclosure that a wrench assembly may be repositionable, such as rotatably coupled to the fill port, or otherwise with respect to the flexible bladder. Other configurations are also within the scope of the present disclosure, including different numbers and/or types of the mating regions.

The illustrated example of a wrench assembly 208 includes a support member 56, a handle 58 extending from the support member, and hanging structure 84 extending from the support member. The support member fully encircles neck 212 of fill port 210 and includes snap-fit structure 220, which as mentioned, is configured to mate with corresponding structure on the outside of the neck of the fill port. Although the support member of fill port 210 is shown completely encircling the neck, it is within the scope of the present disclosure that the support member may only substantially or partially encircle the neck, or even that the support member may merely provide a point of attachment from which the handle extends. Other configurations are also within the scope of the present disclosure.

The handle 58 of wrench assembly 208 may include a plurality of apertures, or holes, 227, as illustrated in FIGS. 2 and 7-9, and optionally in FIG. 4. Additionally or alternatively, as illustrated in FIG. 3 and optionally in FIG. 4, the handle may include a smooth, or a substantially smooth, outer surface. When present, the apertures may be provided as ornamentation for the illustrated embodiment, and are not required for functional operation of the illustrated fill port assembly.

As indicated in the illustrative, non-exclusive example shown in FIG. 4, tether 206 includes a ring 228 that is secured around cap 202 within a channel 230 (as perhaps best seen in FIGS. 5-6) and an arm 232 extending from the ring and having an end region 234 configured to restrict unintentional removal of the tether, and thus the cap, from the fill port assembly. More specifically, arm 232 extends through a passage 236 in wrench assembly 208, and end region 234 of the arm is sized to restrict removal of the arm from the passage.

Cap 202, as mentioned, includes thread structure 216 that is configured to mate with corresponding thread structure 214 of fill port 210. While fill port assembly 200 of reservoir assembly 100 includes a cap with external threads and a fill port with internal threads, it is within the scope of the present disclosure that a fill port according to the present disclosure may include external threads and a cap according to the present disclosure may include internal threads. Furthermore, as mentioned, any suitable structure for sealing the opening to the internal compartment of the flexible bladder is within the scope of the present disclosure, and a threaded arrangement is not required.

Cap 202 further includes gripping portions 238 that are configured to be grasped, or at least engaged, by a user to secure and/or release the cap from the fill port. Gripping portions 238 are defined by a recess 240, which defines a plug portion 242 of the cap. The external thread structure of the cap extends from this plug portion, and when the cap is secured to the fill port, the plug portion extends through the opening defined by the neck of the fill port. The cap of the illustrated, non-exclusive embodiment includes surface ornamentation, such as the curved shape of the gripping portions and the corresponding shape of the recess, and the specific ornamentation thereof is not required for functional operation of the illustrated fill port assembly.

As perhaps best seen in FIG. 4, dryer mechanism 300 of the illustrative, non-exclusive example of a reservoir assembly 100 includes a pair of illustrative, non-exclusive examples of elongate members 78, which in FIGS. 2-4 and 7-8 are indicated generally at 302. Elongate members 302 are pivotally, or hingedly, coupled to the underside of the handle of wrench assembly 208. More specifically, the elongate members each include a hinge member 304 disposed within a socket 306 defined by the handle of the wrench assembly. In the illustrated embodiment, the hinge-member is cone-shaped but may be configured in any suitable manner. The hinge members are configured to pivot, or rotate, within the respective sockets to permit selective deployment of dryer mechanism 300, or more specifically of the elongate members of the dryer mechanism, from stowed configuration 82, such as illustrated in FIGS. 2 and 7-9, to deployed configuration 80, such as illustrated in FIG. 3. Stated differently, the illustrated, non-exclusive examples of elongate members are pivotally coupled relative to the flexible bladder and are configured to be selectively pivoted from the stowed configuration to the deployed configuration to engage outer surface 28 of the flexible bladder and deform the flexible bladder from non-drying configuration 104 to drying configuration 106.

Elongate members 302 each include an arcuate surface 308, as perhaps best seen in FIG. 4, that is adjacent to and partially extends around support member 56 of wrench assembly 208 when dryer mechanism 300 is in its stowed configuration 82, such as illustrated in FIGS. 2 and 7-9. In the illustrative, non-exclusive example of reservoir assembly 100, the elongate members of dryer mechanism 300 are generally hidden from view when in the stowed configuration. Furthermore, the arcuate surfaces of the elongate members engage the outer surface of the flexible bladder so that at least a portion of the outer surface is deformed to at least partially conform to the arcuate surfaces when the dryer mechanism 300 is in its deployed configuration 80 and the flexible reservoir is in its drying configuration 106, such as illustrated in FIG. 3.

As mentioned, FIG. 9 illustrates an illustrative, non-exclusive example of a personal hydration system 10 that includes a back-mounted pack, or backpack, 102. Other configurations of packs (e.g., shoulder packs, waist-mounted packs, etc.), when present, may be used with reservoir assemblies according to the present disclosure and/or may be incorporated into personal hydration systems 10 according to the present disclosure. Backpack 102 includes an internal compartment 108 into which reservoir assembly 100 is received. That is, at least a portion, and optionally all, of the flexible bladder of the reservoir assembly is received within the internal compartment of the pack. The backpack further includes an opening 110 through which the reservoir assembly is removably received into the internal compartment, but it is within the scope of the present disclosure that a reservoir assembly may be permanently, or at least semi-permanently, received into the internal compartment of a pack. Backpack 102 further includes a pair of shoulder straps 112, but it is also within the scope of the present disclosure that a single strap, such as a single shoulder strap and/or a single waist strap, as well as other configurations of harness assemblies, may be used with packs according to the present disclosure.

As seen in FIG. 9, cap 202 is accessible through an opening 114 in the rear surface 116 of the pack. Such an optional configuration in which the cap is easily accessible by a user permits the reservoir assembly to be filled or emptied through the fill port assembly without having to first remove the reservoir assembly from the pack.

Pack 102 also includes a retainer, or positioning device, 118 on the pack that is configured to be engaged by a corresponding positioning device, or clasp, or hanging structure 84 on wrench assembly 208 to support the reservoir assembly within the pack. The combination of the retainer 118 and hanging structure 84 in the illustrated embodiment supports the reservoir assembly within the pack's internal compartment to prevent the reservoir assembly from accumulating in the lower portion of the internal compartment. Because the upper portion of the reservoir assembly is directly or indirectly retained proximate to retainer 118, that portion of the reservoir assembly is retained from shifting or dropping to the lower portions of the pack's internal compartment. Other examples of reservoir assembly retaining structure also may be used and are within the scope of the present disclosure.

The following enumerated paragraphs represent illustrative, non-exclusive ways of describing inventions according to the present disclosure.

A A personal hydration system, comprising:

a flexible bladder that defines an internal compartment for holding a volume of drink fluid, wherein the flexible bladder includes opposing side portions, and wherein the flexible bladder has an outer surface and a central axis;

a fill port assembly coupled to the flexible bladder and defining an opening to the internal compartment, wherein the fill port assembly is configured to selectively seal the opening;

an exit port that defines a passage for delivering drink fluid from the internal compartment; and a dryer mechanism operatively coupled to the flexible bladder and configured to be selectively positioned to engage the outer surface of the flexible bladder and deform the flexible bladder from a non-drying configuration into a drying configuration in which the opposing side portions are spaced further apart from each other and further away from the central axis than when the flexible bladder is in the non-drying configuration to enable circulation of air in the internal compartment.

A1 The personal hydration system of paragraph A, wherein the dryer mechanism includes a stowed configuration in which the dryer mechanism does not deform the flexible bladder into the drying configuration, and a deployed configuration in which the dryer mechanism deforms the flexible bladder into the drying configuration.

A1.1 The personal hydration system of paragraph A1, wherein at least a portion of the dryer mechanism is hidden from view when the dryer mechanism is in the stowed configuration and the at least a portion of the dryer mechanism is not hidden from view when the dryer mechanism is in the deployed configuration.

A2 The personal hydration system of any of paragraphs A-A1.1, wherein the dryer mechanism is configured to selectively squeeze the flexible bladder to configure the flexible bladder from the non-drying configuration into the drying configuration.

A3 The personal hydration system of any of paragraphs A-A2, wherein the dryer mechanism is configured to selectively increase the volume of the internal compartment to configure the flexible bladder into the drying configuration.

A4 The personal hydration system of any of paragraphs A-A3, wherein the flexible bladder includes a front panel and a rear panel coupled to the front panel to define a seam between the front panel and the rear panel; and wherein the dryer mechanism is configured to selectively engage the seam of the flexible bladder and translate the seam toward the central axis to selectively configure the flexible bladder into the drying configuration.

A5 The personal hydration system of any of paragraphs A-A4, wherein the flexible bladder includes a front portion, a rear portion, a left portion, and a right portion; and wherein the dryer mechanism is configured to be selectively positioned to engage the left portion and the right portion and urge the left portion and the right portion toward the central axis and toward each other, but not in contact with each other, to configure the flexible bladder into the drying configuration.

A5.1 The personal hydration system of paragraph A5, wherein the dryer mechanism is further configured to be selectively positioned to engage the left portion and the right portion and urge the front portion away from the rear portion to configure the flexible bladder into the drying configuration.

A5.2 The personal hydration system of any of paragraphs A5-A5.1, wherein the fill port assembly is disposed on the front portion.

A6 The personal hydration system of any of paragraphs A-A5.1, wherein the dryer mechanism is coupled to the fill port assembly.

A6.1 The personal hydration system of paragraph A6, wherein the fill port assembly includes a handle, and wherein the dryer mechanism is coupled to the handle.

A7 The personal hydration system of any of paragraphs A-A5.1, wherein the dryer mechanism is coupled to the flexible bladder.

A8 The personal hydration system of any of paragraphs A-A7, wherein the dryer mechanism includes at least one elongate member configured to be selectively positioned to engage the outer surface of the flexible bladder and deform the flexible bladder from the non-drying configuration to the drying configuration.

A8.1 The personal hydration system of paragraph A8, wherein the at least one elongate member includes two elongate members.

A8.1.1 The personal hydration system of paragraph A8.1, wherein the flexible bladder includes a pair of edge regions; and wherein each of the two elongate members are configured to be selectively positioned to engage a respective one of the pair of edge regions and deform the flexible bladder from the non-drying configuration to the drying configuration.

A8.2 The personal hydration system of any of paragraphs A8-A8.1.1, wherein the dryer mechanism includes a stowed configuration in which the dryer mechanism does not deform the flexible bladder into the drying configuration, and a deployed configuration in which the dryer mechanism deforms the flexible bladder into the drying configuration; and wherein the at least one elongate member is pivotally coupled relative to the flexible bladder and is configured to be selectively pivoted from the stowed configuration to the deployed configuration to engage the outer surface of the flexible bladder and deform the flexible bladder from the non-drying configuration to the drying configuration.

A8.2.1 The personal hydration system of paragraph A8.2, wherein the at least one elongate member is pivotally coupled to the fill port assembly.

A8.2.1.1 The personal hydration system of paragraph A8.2.1, wherein the fill port assembly includes a support member that at least substantially, and optionally completely, encircles the opening to the internal compartment.

A8.2.1.1.1 The personal hydration system of paragraph A8.2.1.1, wherein the fill port assembly further includes a handle that extends from the support member, wherein the handle includes an outer side generally facing away from the flexible bladder and an underside generally facing toward the flexible bladder, and wherein the at least one elongate member is pivotally coupled to the handle.

A8.2.1.1.1.1 The personal hydration system of paragraph A8.2.1.1.1, wherein the at least one elongate member is pivotally coupled to the underside of the handle.

A8.2.1.1.2 The personal hydration system of any of paragraphs A8.2.1.1-A8.2.1.1.1.1, wherein the least one elongate member is at least partially adjacent to the support member when the dryer mechanism is in the stowed configuration and is pivotally spaced away from the support member when the dryer mechanism is in the deployed configuration.

A8.2.1.1.2.1 The personal hydration system of paragraph A8.2.1.1.2, wherein the at least one elongate member includes an arcuate surface that is adjacent to and partially extends around the support member when the dryer mechanism is in the stowed configuration, and the arcuate surface engages the outer surface of the flexible bladder so that at least a portion of the outer surface is deformed to at least partially conform to the arcuate surface of the at least one elongate member when the dryer mechanism is in the deployed configuration and the flexible reservoir is in the drying configuration.

A8.2.1.2 The personal hydration system of any of paragraphs A8.2.1-A8.2.1.1.2.1, wherein the fill port assembly includes at least one socket; and wherein the at least one elongate member includes a hinge member disposed within the at least one socket and configured to rotate within the socket.

A8.2.1.2.1 The personal hydration system of paragraph A8.2.1.2, wherein the hinge member is cone-shaped.

A8.3 The personal hydration system of any of paragraphs A8-A8.2.1.1.2, wherein the at least one elongate member includes an arcuate surface, wherein at least a portion of the outer surface is deformed to at least partially conform to the arcuate surface of the at least one elongate member when the flexible reservoir is in the drying configuration.

A9 The personal hydration system of any of paragraphs A-A8.3, further comprising:

a downstream assembly extending from the exit port to define a fluid conduit through which drink fluid may flow from the internal compartment, wherein the downstream assembly includes a plurality of fluidly interconnected components including one or more of a length of hollow drink tubing through which drink fluid may flow, an on/off valve configured to selectively obstruct the fluid conduit and restrict drink fluid from flowing through the fluid conduit, a mouthpiece configured to dispense drink fluid to a user's mouth, a bite-actuated mouthpiece configured to dispense drink fluid to a user's mouth upon receipt of user-applied compressive forces to the mouthpiece, a gas mask fitting adapted to fluidly connect the downstream assembly to an intake of a gas mask, and a quick connect assembly configured to selectively and fluidly interconnect at least two of the plurality of fluidly interconnected components.

A10 The personal hydration system of any of paragraphs A-A9, further comprising:

a pack, wherein the flexible bladder is disposed at least partially within the pack.

A11 The personal hydration system of any of paragraphs A-A10, wherein the fill port assembly includes a cap configured to selectively seal the opening.

A11.1 The personal hydration system of paragraph A11, wherein the fill port assembly further includes a fill port coupled to the flexible bladder, the fill port defining a neck, wherein the cap is configured to selectively mate with the neck to seal the opening.

A11.2 The personal hydration system of any of paragraph A11-A11.1, wherein the exit port is coupled to the cap, and wherein the passage for delivering drink fluid from the internal compartment extends through the cap.

A12 The personal hydration system of any of paragraphs A-A10, wherein the exit port is coupled to the flexible bladder, and wherein the passage for delivering drink fluid from the internal compartment extends through the flexible bladder.

A13 The personal hydration system of any of paragraphs A-A10 and A12, wherein the opening is a lateral opening;

wherein the flexible bladder is formed of two films having the majority of their perimeter fused, and a portion of the perimeter unfused so as to present the lateral opening for filling the internal compartment with drink fluid; and wherein the fill port assembly includes:

a rod having a first end and a second end fixedly attached to the flexible bladder laterally across the lateral opening so that a portion of the flexible bladder adjacent the lateral opening can be folded over the rod and substantially overlap an adjacent portion of the flexible bladder; and a sealer comprising an elongated rigid member having two opposite sides along which a hollow cavity is extended with a longitudinal slot wherein said slot is adapted to accommodate the said two films, wherein the sealer is provided with an opening on at least one of the opposite sides with a broadening for inserting an end of the rod into the cavity when the portion of the flexible bladder is folded over the rod into the hollow cavity, the slot being narrower than the diameter of the rod, so that the sealer is only to be slidingly mounted sideways over the rod.

A14 The personal hydration system of any of paragraphs A-A10 and A12, wherein the opening has a closed length when the fill port assembly is in a closed configuration;

wherein the fill port assembly includes:

a first end of the flexible bladder, the first end having a first lip with a first catch positioned opposite a second lip with a second catch;

a sealing member configured to slidably attach to the flexible bladder, and wherein the sealing member has a seal length, and wherein the seal length is at least substantially equal to the opening closed length, and wherein the sealing member is configured to seal the opening, and wherein the sealing member has a substantially straight configuration;

wherein the sealing member comprises a channel defined by a sealing member first side, a sealing member second side, and a first upper arm and a first lower arm extending from the sealing member first side and positioned opposite a second upper arm and a second lower arm extending from the sealing member second side; and wherein the channel is configured to receive the first and second catches of the flexible bladder as the sealing member is slidably attached to the flexible bladder such that the first and second upper arms compress the first and second lips above the received first and second catches, the first and second lower arms compress the first and second lips below the received first and second catches to seal the container, and the first and second catches prevent substantial movement of the sealing member in a vertical direction relative to the flexible bladder.

B A personal hydration system, comprising:

a flexible bladder that defines an internal compartment for holding a volume of drink fluid, wherein the flexible bladder includes opposing side portions, and wherein the flexible bladder has an outer surface and a central axis;

a fill port assembly coupled to the flexible bladder and defining an opening to the internal compartment, wherein the fill port assembly is configured to selectively seal the opening;

an exit port that defines a passage for delivering drink fluid from the internal compartment; and means for engaging the outer surface of the flexible bladder and drying the internal compartment.

C A personal hydration system, comprising:

a flexible bladder that defines an internal compartment for holding a volume of drink fluid, wherein the flexible bladder includes opposing side portions, and wherein the flexible bladder has an outer surface and a central axis;

a fill port assembly coupled to the flexible bladder and defining an opening to the internal compartment, wherein the fill port assembly is configured to selectively seal the opening;

an exit port that defines a passage for delivering drink fluid from the internal compartment; and means for engaging the outer surface of the flexible bladder and configuring the flexible bladder from a non-drying configuration into a drying configuration in which the opposing side portions are spaced further apart from each other and further away from the central axis than when the flexible bladder is in the non-drying configuration to enable circulation of air in the internal compartment.

D A personal hydration system kit, comprising:

a reservoir assembly including:

a flexible bladder that defines an internal compartment for holding a volume of drink fluid, wherein the flexible bladder includes opposing side portions, and wherein the flexible bladder includes an outer surface and a central axis;

a fill port assembly coupled to the flexible bladder and defining an opening to the internal compartment, wherein the fill port assembly is configured to selectively seal the opening; and an exit port that defines a passage for delivering drink fluid from the internal compartment; and a dryer mechanism configured to be positioned to selectively engage the outer surface of the flexible bladder and deform the flexible bladder from a non-drying configuration into a drying configuration in which the opposing side portions are spaced further apart from each other and further away from the central axis than when the flexible bladder is in the non-drying configuration to enable circulation of air in the internal compartment.

D1 The personal hydration kit of paragraph D, wherein the reservoir assembly and/or the dryer mechanism includes structure described in any of paragraphs A-C.

E A dryer mechanism for use with a personal hydration system reservoir assembly that includes a flexible bladder having an outer surface and that defines an internal compartment for holding a volume of drink fluid and includes opposing side portions and a central axis, wherein:

the dryer mechanism is configured to be positioned to selectively engage the outer surface of the flexible bladder and deform the flexible bladder from a non-drying configuration into a drying configuration in which the opposing side portions are spaced further apart from each other and further away from the central axis than when the flexible bladder is in the non-drying configuration to enable circulation of air in the internal compartment.

E1 The dryer mechanism of paragraph E, wherein the dryer mechanism includes structure of the dryer mechanism described in any of paragraphs A-C F A method of drying an internal compartment of a personal hydration system reservoir assembly that includes a flexible bladder having an outer surface and that defines the internal compartment for holding a volume of drink fluid and includes opposing side portions and a central axis, the method comprising:

engaging the outer surface of the flexible bladder; and deforming the flexible bladder from a non-drying configuration into a drying configuration in which the opposing side portions are spaced further apart from each other and further away from the central axis than when the flexible bladder is in the non-drying configuration to enable circulation of air in the internal compartment.

F1 The method of paragraph F, wherein the deforming includes squeezing the flexible bladder.

F2 The method of any of paragraphs F-F1, wherein the deforming includes urging side regions of the flexible bladder toward each other.

F3 The method of any of paragraphs F-F2, wherein the deforming includes increasing the volume of the internal compartment.

F4 The method of any of paragraphs F-F3, wherein the flexible bladder includes a front panel and a rear panel coupled to the front panel to define a seam between the front panel and the rear panel;

wherein the engaging includes engaging the seam of the flexible bladder; and wherein the deforming includes urging the seam toward the central axis.

F5 The method of any of paragraphs F-F4, wherein the flexible bladder includes a front portion, a rear portion, a left portion, and a right portion;

wherein the engaging includes engaging the left portion and the right portion; and wherein the deforming includes urging the left portion and the right portion toward the central axis.

F6 The method of any of paragraphs F-F6, wherein the personal hydration system reservoir assembly further includes a dryer mechanism; and wherein the engaging and the deforming are performed at least partially by the dryer mechanism.

F6.1 The method of paragraph F5, wherein the dryer mechanism includes a stowed configuration in which the dryer mechanism is not deforming the flexible bladder and a deployed configuration in which the dryer mechanism is deforming the flexible bladder.

F6.2 The method of any of paragraphs F6-F6.1, wherein personal hydration system reservoir assembly further includes a fill port assembly coupled to the flexible bladder; and wherein the dryer mechanism is coupled to the fill port assembly.

F6.2.1 The method of paragraph F6.2, wherein the fill port assembly includes a handle; and wherein the dryer mechanism is coupled to the handle.

F6.3 The method of any of paragraphs F6-F6.2, wherein the dryer mechanism includes at least one elongate member; and wherein the engaging and the deforming are performed at least partially by the at least one elongate member.

F6.3.1 The method of paragraph F6.3, wherein the at least one elongate member includes two elongate members.

F6.3.2 The method of any of paragraphs F6.3-F6.3.1, wherein the at least one elongate member is pivotally coupled to the fill port assembly.

F7 The method of any of paragraphs F-F6.3.2, wherein the method is performed by and/or implemented in conjunction with the personal hydration system of any of paragraphs A-C.

G The use of the personal hydration system of any of paragraphs A-C.

H The use of the personal hydration system kit of any of paragraphs D-D1.

I The use of the dryer mechanism of any of paragraphs E-E1.

As used herein, "selective" and "selectively," when modifying an action, movement, configuration, or other activity of one or more components or characteristics of a personal hydration system according to the present disclosure, means that the specified action, movement, configuration, or other activity is a direct or indirect result of user manipulation of an aspect of, or one or more components of, the personal hydration system.

In the event that any of the patent documents that are incorporated by reference herein define a term in a manner or are otherwise inconsistent with either the non-incorporated disclosure of the present application or with any of the other incorporated patent documents, the non-incorporated disclosure of the present application shall control and the term or terms as used therein only control with respect to the patent document in which the term or terms are defined.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

INDUSTRIAL APPLICABILITY

The personal hydration systems, dryer mechanisms for use with personal hydration systems, and methods of drying personal hydration system reservoirs of the present disclosure are applicable to the hydration field, and are specifically applicable to portable drink containers with flexible bladders.

The invention claimed is:

1. A personal hydration system, comprising:

a reservoir assembly, wherein the reservoir assembly comprises:

a flexible bladder that defines an internal compartment for holding a volume of drink fluid, wherein the flexible bladder includes opposing side portions, and wherein the flexible bladder has an outer surface and a central axis;

a fill port assembly coupled to the flexible bladder and defining an opening to the internal compartment, wherein the fill port assembly is configured to selectively seal the opening;

an exit port that defines a passage for delivering drink fluid from the internal compartment; and a dryer mechanism operatively coupled to the flexible bladder and configured to be selectively positioned to engage the outer surface of the flexible bladder to deform and retain the flexible bladder when the internal compartment is nearly empty of drink fluid and when the opening is not sealed from a non-drying configuration into a drying configuration in which the opposing side portions are spaced further apart from each other and further away from the central axis than when the flexible bladder is in the non-drying configuration to enable circulation of air in the internal compartment.

2. The personal hydration system of claim 1, wherein the dryer mechanism includes a stowed configuration in which the dryer mechanism does not deform the flexible bladder into the drying configuration, and a deployed configuration in which the dryer mechanism deforms the flexible bladder into the drying configuration.

3. The personal hydration system of claim 1, wherein the dryer mechanism is configured to selectively squeeze the flexible bladder to configure the flexible bladder from the non-drying configuration into the drying configuration.

4. The personal hydration system of claim 1, wherein the flexible bladder includes a front panel and a rear panel coupled to the front panel to define a seam between the front panel and the rear panel; and wherein the dryer mechanism is configured to selectively engage the seam of the flexible bladder and translate the seam toward the central axis to selectively configure the flexible bladder into the drying configuration.

5. The personal hydration system of claim 1, wherein the flexible bladder includes a front portion, a rear portion, a left portion, and a right portion; and wherein the dryer mechanism is configured to be selectively positioned to engage the left portion and the right portion and urge the left portion and the right portion toward the central axis and toward each other so that the front portion is urged away from the rear portion to thereby configure the flexible bladder into the drying configuration.

6. The personal hydration system of claim 5, wherein the dryer mechanism is further configured to be selectively positioned to engage the left portion and the right portion and urge the front portion away from the rear portion to configure the flexible bladder into the drying configuration.

7. The personal hydration system of claim 1, wherein the dryer mechanism is coupled to the fill port assembly.

8. The personal hydration system of claim 7, wherein the fill port assembly includes a handle, and wherein the dryer mechanism is coupled to the handle.

9. The personal hydration system of claim 1, wherein the dryer mechanism includes at least one elongate member configured to be selectively positioned to engage the outer surface of the flexible bladder to deform the flexible bladder from the non-drying configuration to the drying configuration.

10. The personal hydration system of claim 9, wherein the at least one elongate member includes two generally opposed, spaced-apart elongate members.

11. The personal hydration system of claim 10, wherein the flexible bladder includes a pair of edge regions; and wherein each of the two elongate members are configured to be selectively positioned to engage a respective one of the pair of edge regions to deform the flexible bladder from the non-drying configuration to the drying configuration.

12. The personal hydration system of claim 9, wherein the dryer mechanism includes a stowed configuration in which the dryer mechanism does not engage the flexible bladder and does not deform the flexible bladder into the drying configuration, and a deployed configuration in which the dryer mechanism engages the flexible bladder and deforms the flexible bladder into the drying configuration; and wherein the at least one elongate member is pivotally coupled relative to the flexible bladder and is configured to be selectively pivoted from the stowed configuration to the deployed configuration to engage the outer surface of the flexible bladder to deform the flexible bladder from the non-drying configuration to the drying configuration.

13. The personal hydration system of claim 12, wherein the at least one elongate member is pivotally coupled to the fill port assembly.

14. The personal hydration system of claim 13, wherein the fill port assembly includes a support member that at least substantially encircles the opening to the internal compartment and a handle that extends from the support member, wherein the handle includes an outer side generally facing away from the flexible bladder and an underside generally facing toward the flexible bladder, and wherein the at least one elongate member is pivotally coupled to the underside of the handle.

15. The personal hydration system of claim 14, wherein the least one elongate member is at least partially adjacent to the support member when the dryer mechanism is in the stowed configuration and is pivotally spaced away from the support member when the dryer mechanism is in the deployed configuration.

16. The personal hydration system of claim 9, wherein the at least one elongate member includes an arcuate surface, wherein at least a portion of the outer surface is deformed to at least partially conform to the arcuate surface of the at least one elongate member when the flexible reservoir is in the drying configuration.

17. The personal hydration system of claim 1, wherein the reservoir assembly further comprises:

a downstream assembly extending from the exit port to define a fluid conduit through which drink fluid may flow from the internal compartment, wherein the downstream assembly includes a plurality of fluidly interconnected components including one or more of a length of hollow drink tubing through which drink fluid may flow, an on/off valve configured to selectively obstruct the fluid conduit and restrict drink fluid from flowing through the fluid conduit, a mouthpiece configured to dispense drink fluid to a user's mouth, a bite-actuated mouthpiece configured to dispense drink fluid to a user's mouth upon receipt of user-applied compressive forces to the mouthpiece, and a gas mask fitting adapted to fluidly connect the downstream assembly to an intake of a gas mask, and a quick connect assembly configured to selectively and fluidly interconnect at least two of the plurality of fluidly interconnected components, wherein the downstream assembly does not form a portion of the dryer mechanism.

18. The personal hydration system of claim 1, further comprising:

a pack, wherein the flexible bladder is disposed at least partially within the pack.

19. A personal hydration system, comprising:

a reservoir assembly, wherein the reservoir assembly comprises:

a flexible bladder that defines an internal compartment for holding a volume of drink fluid, wherein the flexible bladder includes opposing side portions, and wherein the flexible bladder has an outer surface and a central axis;

a fill port assembly coupled to the flexible bladder and defining an opening to the internal compartment, wherein the fill port assembly is configured to selectively seal the opening;

an exit port that defines a passage for delivering drink fluid from the internal compartment; and means for engaging the outer surface of the flexible bladder to configure and retain the flexible bladder when the internal compartment is nearly empty of drink fluid and when the opening is not sealed from a non-drying configuration into a drying configuration in which the opposing side portions are spaced further apart from each other and further away from the central axis than when the flexible bladder is in the non-drying configuration to enable circulation of air in the internal compartment.

20. A personal hydration system kit, comprising:

a reservoir assembly including:

a flexible bladder that defines an internal compartment for holding a volume of drink fluid, wherein the flexible bladder includes opposing side portions, and wherein the flexible bladder includes an outer surface and a central axis;

a fill port assembly coupled to the flexible bladder and defining an opening to the internal compartment, wherein the fill port assembly is configured to selectively seal the opening; and an exit port that defines a passage for delivering drink fluid from the internal compartment; and a dryer mechanism configured to be positioned to selectively engage the outer surface of the flexible bladder to deform and retain the flexible bladder when the internal compartment is nearly empty of drink fluid and when the opening is not sealed from a non-drying configuration into a drying configuration in which the opposing side portions are spaced further apart from each other and further away from the central axis than when the flexible bladder is in the non-drying configuration to enable circulation of air in the internal compartment.

21. The personal hydration system of claim 13, wherein the at least one elongate member includes two spaced-apart elongate members.

* * * * *